United States Patent [19]

Ealer

[11] Patent Number: 4,907,381

[45] Date of Patent: Mar. 13, 1990

[54] GUTTER SCREEN

[75] Inventor: James E. Ealer, St. Clair, Mo.

[73] Assignee: Custon Seamless Guttering, St. Clair, Mo.

[21] Appl. No.: 263,703

[22] Filed: Oct. 28, 1988

Related U.S. Application Data

[63] Continuation of Ser. No. 877,529, Jun. 23, 1986, abandoned.

[51] Int. Cl.[4] ..... E04D 13/00

[52] U.S. Cl. ..... 52/12

[58] Field of Search ..... 52/11, 12, 15

[56] References Cited

U.S. PATENT DOCUMENTS

| | | | |
|---|---|---|---|
| 2,175,521 | 10/1939 | Fry | 52/12 |
| 2,209,741 | 7/1940 | Sullivan et al. | 52/11 X |
| 3,067,881 | 12/1962 | Goosmann | 52/12 X |
| 3,351,206 | 11/1967 | Wennerstrom | 52/12 X |

*Primary Examiner*—Carl D. Friedman

*Attorney, Agent, or Firm*—Senniger, Powers, Leavitt and Roedel

[57] ABSTRACT

A gutter screen adapted for covering a gutter and preventing leaves and the like from falling into the gutter. The gutter has front, back and bottom walls and a flange projecting rearwardly from the front wall of the gutter and spaced above the bottom wall of the gutter. The gutter screen comprises a flexible resilient screen member having an integral front edge margin bent to form a channel adapted for receiving the gutter flange therein, and a rear edge margin adapted for engaging a gutter hanger on the rear wall of the gutter. The screen member is adapted to be resiliently bent to an arcuate configuration in which the front edge margin and rear edge margin of the screen member are adapted for pressure engagement with the gutter and gutter hanger thereby securely to maintain the gutter screen on the gutter.

16 Claims, 1 Drawing Sheet

GUTTER SCREEN

This is a continuation of application Ser. No. 877,529, filed June 23, 1986, now abandoned.

BACKGROUND OF THE INVENTION

This invention relates generally to rain gutters, and more particularly to a gutter screen for such gutters.

Since leaves and other debris frequently clog up rain gutters, some kind of guard or screen which prevents leaves from falling into the gutter is desirable. However, conventional gutter screens may become overburdened by such debris and collapse into the gutter, thereby aggravating the problem instead of solving it.

One such conventional gutter screen comprises a strip of non-resilient mesh screen cut to be wider than the gutter so that when the striP is placed flat on the gutter it spans the front and back walls of the gutter and projects rearwardly beyond the back wall of the gutter under the eave of the house. The screen has a channel-shaped member along its front edge for receiving a lip bent rearwardly from the top of the front wall of the gutter thereby to hold the screen loosely in place on the gutter. However, as leaves and other debris pile up on this gutter screen, the center of the screen typically begins to bow down until finally the entire gutter screen collapses into the gutter. In addition, since the gutter screen is not securely attached to the gutter, it may become loose and fall off in high winds or be forced off by the action of small animals.

SUMMARY OF THE INVENTION

Among the several objects of the invention may be noted the provision of an improved gutter screen, particularly adapted for reducing manufacturing and installation costs; the provision of such a gutter screen which keeps leaves and other solid matter out of the gutter to prevent clogging of the gutter; the provision of such a gutter screen which is not likely to collapse under the weight of leaves and debris and which is securely connected to the gutter; and the provision of such gutter screen which is durable and which does not detract from the appearance of a building.

Generally, a gutter screen of this invention is adapted for covering a gutter and preventing leaves and the like from falling into the gutter. The gutter has front, back and bottom walls and a flange projecting rearwardly from the front wall of the gutter spaced above the bottom wall of the gutter. The gutter screen comprises a flexible resilient screen member having an integral front edge margin bent to form a forward-opening channel adapted for receiving the gutter flange therein, the channel comprising generally rearwardly and forwardly extending portions generally adapted to overlie and underlie the gutter flange thereby to secure the front edge of the screen member to the gutter flange so that the gutter screen does not sag. The screen member also has a rear edge margin adapted for engaging a gutter hanger on the back wall of the gutter. The screen member is adapted to be resiliently bent to an arcuate configuration in which the front edge margin and rear edge margin of the screen member are adapted for pressure engagement with the gutter and gutter hanger thereby securely to maintain the gutter screen on the gutter.

In another aspect of this invention, a gutter screen is provided in combination with a rain gutter and a hanger for hanging the gutter under the edge of a roof. The gutter has front, back and bottom walls and a flange projecting rearwardly from the front wall of the gutter spaced above the bottom wall of the gutter. The hanger extends forwardly from the rear wall of the gutter to a position under the gutter flange. The gutter screen comprises a flexible resilient screen member having an integral front edge margin bent to form a forwardly-opening channel for receiving the gutter flange therein, the channel comprising generally rearwardly and forwardly extending portions generally adapted to overlie and underlie the gutter flange thereby to secure the front edge of the screen member to the gutter flange so that the gutter screen does not sag. The screen member also has a rear edge margin adapted for engaging the gutter hanger on the back wall of the gutter. The screen member is adapted to be resiliently bent to an arcuate configuration in which the front edge margin and rear edge margin of the screen member are in pressure engagement with the gutter and gutter hanger thereby securely to maintain the gutter screen on the gutter.

Other objects and features will be in part apparent and in part pointed out hereinafter.

DESCRIPTION OF PREFERRED EMBODIMENTS

Figure 1:
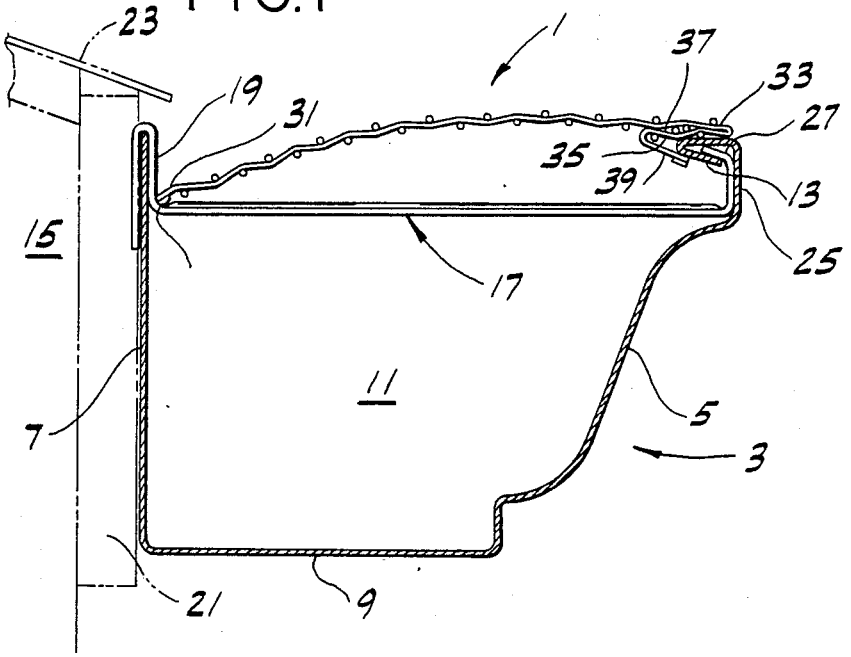
FIG. 1 is a transverse cross-sectional view of a gutter screen of the present invention on a gutter.

Now referring to the drawings, a gutter screen of the present invention is designated in its entirety by the reference numeral 1. Gutter screen 1 is particularly adapted for covering a conventional rain gutter, such as indicated generally at 3, and preventing leaves and the like from falling into the gutter.

As shown in FIG. 1, gutter 3 has a front wall 5, a back wall 7 and a bottom wall 9, which form a channel 11 for drainage of rainwater. Front wall 5 maY be provided with a decorative and/or strengthening configuration, as shown. A conventional lip or flange 13 projects rearwardly from the front wall 5 and is spaced above the bottom wall 7 of the gutter. Flange 13 strengthens the gutter and provides a smooth top edge to front wall 5.

Gutter 3 may be attached to the outside wall 15 of a building by gutter hangers, one of which is shown and designated 17. The hanger has a back portion 19 bent to hook over the back wall of gutter 3 and adapted to receive a fastening device, such as a screw or nail, to secure the gutter to a cornice 21 on wall 15 adjacent the roof 23. Hanger 17 extends over channel 11 to a section 25 of front wall 5 under flange 13 to support the front wall and reinforce it against inwardly directed pressures, such as are frequently caused by ladders leaning against the gutter. A front portion 27 of hanger 17 is bent to fit inside flange 13 to reinforce the front wall against outwardly directed forces, such as caused by someone pulling on the gutter while climbing onto roof 23.

Preferably, gutter screen (or screen member) 1 has an integral rear edge margin 29 adapted for engaging a bend 31 on hanger 17 adjacent back wall 7 of the gutter, and an integral front edge margin 33 extending generally parallel to the rear edge margin. Front edge margin 33 is bent to form a forwardly-opening channel 35 having a generally V-shaped configuration in transverse section and thereby adapted for receiving flange 13 therein. For example, a rearwardly extending portion 37 may be bent back from the front edge of the screen member so as to extend generally parallel to the screen member, and a forwardly extending portion 39 may be bent forward from the rearwardly extending portion 37 at an angle of approximately 45 degrees therefrom to form channel 35. Portions 37 and 39 are divergent in the forward direction relative to the channel to form a relatively wide channel mouth for ready passage of the gutter glange 13 through the channel mouth into a position where the flange is held captive between the upper and lower portions 37, 39 of the channel. Other configurations may also be suitable.

Figure 2:
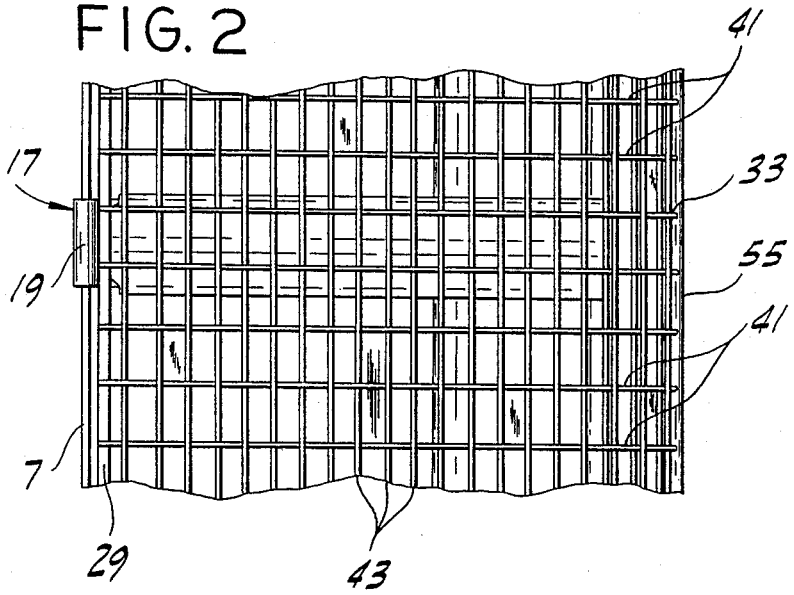
FIG. 2 is a top plan view of the gutter screen and gutter of FIG. 1.

The gutter screen is formed of flexible resilient metal, such as an aluminum or steel alloy, and is of integral construction, that is, it is formed from a single continuous section of screening. As shown in FIG. 2, the gutter screen includes strands of wire 41 running perpendicular to edge margins 29 and 33 and strands of wire 43 running parallel to the edge margins, the strands 41, 43 being interwoven with one another to form a unitary wire mesh screen. This orientation is believed to cause the gutter screen to be stiffer than it would otherwise be.

In accordance with this invention, the width of the gutter screen (i.e., from front edge margin 33 to rear edge margin 29) is greater than the width of the gutter (i.e., between bend 31 of the hanger and flange 13) so that the screen may resiliently be bent to the arcuate configuration shown in FIG. 1 wherein the front edge margin 33 and rear edge margin 33 of the screen member are in pressure (spring-like) engagement with the gutter and gutter hanger, respectively, thereby securely to maintain the gutter screen on the gutter until such time as it is manually removed. The arched configuration of the screen also increases the load-bearing capability of the screen.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A gutter screen adapted for covering a gutter and preventing leaves and the like from falling into the gutter, said gutter having front, back and bottom walls and a flange projecting rearwardly from the front wall of the gutter and spaced above the bottom wall of the gutter, said flange extending substantially continuously along the entire length of the gutter, said gutter screen comprising an elongate flexible resilient generally planar non-arcuate screen member having an integral front edge margin bent to form a forwardly-opening channel generally V-shaped in transverse section extending substantially continuously along the entire length of the screen for receiving said gutter flange therein, said channel comprising an upper rearwardly extending portion bent back from the front edge of the screen member and adapted to overlie the gutter flange and engage the gutter flange substantially continuously along substantially the entire length of the gutter screen for supporting the screen on the flange substantially continuously along substantially the entire length of the screen to prevent sagging of the screen, and a lower forwardly extending portion bent forward from the upper rearwardly extending portion and adapted to closely underlie the gutter flange, said upper and lower portions being divergent in the forward direction with respect to the channel to form a relatively wide channel mouth for permitting ready passage of the gutter flange through the channel mouth into a position where the gutter flange is between said upper and lower portions, said screen member further having a rear edge margin adapted for engaging a gutter hanger on the back wall of the gutter, said screen member being adapted to be resiliently bent to an arcuate configuration in which the front edge margin and rear edge margin of the screen member are adapted for pressure engagement with the gutter and gutter hanger thereby securely to maintain the gutter screen on the gutter.

2. A gutter screen as set forth in claim 1 wherein said screen member is a wire screen member.

3. A gutter screen as set forth in claim 2 wherein the front edge margin of the screen member extends generally parallel to the rear edge margin of the screen member.

4. A gutter screen as set forth in claim 3 wherein said wire screen member includes wire running perpendicular to said edge margins and wire running parallel to said edge margins.

5. A gutter screen as set forth in claim 1 wherein said screen member is of aluminum alloy steel.

6. A gutter screen as set forth in claim 1 wherein said rearwardly extending portion of the screen member extends generally parallel to the screen member.

7. A gutter screen as set forth in claim 6 wherein said forwardly extending portion is at an angle of approximately 45 degrees from said rearwardly extending portion of the screen member.

8. A gutter screen as set forth in claim 1 wherein said screen member has a generally flat non-arcuate configuration when unstressed, said screen member being resiliently bendable from said flat configuration to said arcuate configuration.

9. In combination with a rain gutter having front, back and bottom walls and a flange projecting rearwardly from the front wall of the gutter and spaced above the bottom wall of the gutter, said flange extending substantially continuously along the entire length of the gutter, and a hanger for hanging the gutter under the edge of a roof, said hanger extending forwardly from the rear wall of the gutter to a position under said gutter flange; a gutter screen comprising an elongate flexible resilient generally planar non-arcuate screen member having an integral front edge margin bent to form a forwardly-opening channel generally V-shaped in transverse section extending substantially continuously along the entire length of the screen for receiving said gutter flange therein, said channel comprising an upper rearwardly extending portion bent back from the front edge of the screen member and adapted to overlie the gutter flange and engage the gutter flange substantially continuously along substantially the entire length of the gutter screen for supporting the screen on the flange substantially continuously along substantially the entire length of the screen to prevent sagging of the screen, and a lower forwardly extending portion bent forward from the upper rearwardly extending portion and adapted to closely underlie the gutter flange, said upper and lower portions being divergent in the forward direction with respect to the channel to form a relatively wide channel mouth for permitting ready passage of the gutter flange through the channel mouth into a position where the gutter flange is between said upper and lower portions, said screen member further having a rear edge margin for engaging said gutter hanger on the back wall of the gutter, said screen member being adapted to be resiliently bent to an arcuate configuration in which the front edge margin and rear edge margin of the screen member are in pressure engagement with the gutter and gutter hanger thereby securely to maintain the gutter screen on the gutter.

10. A combination as set forth in claim 9 wherein said screen member is a wire screen member.

11. A combination as set forth in claim 10 wherein the front edge margin of the screen member extends generally parallel to the rear edge margin of the screen member.

12. A combination as set forth in claim 11 wherein said ire screen member includes wire running perpendicular to said edge margins and wire running parallel to said edge margins.

13. A combination as set forth in claim 9 wherein said screen member is of aluminum alloy or steel.

14. A combination as set forth in claim 9 wherein said rearwardly extending portion of the screen member extends generally parallel to the screen member.

15. A combination as set forth in claim 14 wherein said forwardly extending portion is at an angle of approximately 45 degrees from said rearwardly extending portion of the screen member.

16. A combination as set forth in claim 8 wherein said screen member has a generally flat non-arcuate configuration when unstressed, said screen member being resiliently bendable from said flat configuration to said arcuate configuration.

* * * * *

UNITED STATES PATENT AND TRADEMARK OFFICE

CERTIFICATE OF CORRECTION

PATENT NO. : 4,907,381

DATED : March 13, 1990

INVENTOR(S) : James E. Ealer

It is certified that error appears in the above-identified patent and that said Letters Patent is hereby corrected as shown below:

Column 4, line 29, "alloy steel", should read ---alloy or steel---.

Column 6, line 2, "said ire", should read ---said wire---.

Signed and Sealed this

Twenty-first Day of May, 1991

*Attest:*

*Attesting Officer*

HARRY F. MANBECK, JR.

*Commissioner of Patents and Trademarks*